United States Patent [19]

Kashimura

[11] Patent Number: 4,485,786

[45] Date of Patent: Dec. 4, 1984

[54] AIR-FUEL RATIO CONTROL APPARATUS

[75] Inventor: Yuichi Kashimura, Katsuta, Japan

[73] Assignee: Hitachi, Ltd., Tokyo, Japan

[21] Appl. No.: 514,273

[22] Filed: Jul. 15, 1983

[30] Foreign Application Priority Data

Jul. 15, 1982 [JP] Japan ..... 57-122066

[51] Int. Cl.[3] ..... F02D 33/00

[52] U.S. Cl. ..... 123/440; 123/489; 123/589

[58] Field of Search ..... 123/440, 489, 589; 60/276

[56] References Cited

U.S. PATENT DOCUMENTS 4,155,335 5/1979 Hosaka et al. ..... 123/440
4,214,563 7/1980 Hosaka ..... 123/440
4,385,613 5/1983 Yoshida et al. ..... 123/440

FOREIGN PATENT DOCUMENTS 52-97029 8/1977 Japan .
55-112838 9/1980 Japan ..... 123/489

*Primary Examiner*—Andrew M. Dolinar
*Attorney, Agent, or Firm*—Antonelli, Terry & Wands

[57] ABSTRACT

In an air-fuel ratio control apparatus for controlling the air-fuel ratio of an engine in accordance with the output of an $O_2$ sensor, in response to the starting of the engine the output voltage of the $O_2$ sensor is sampled at intervals of a unit time. The slope of the output voltage waveform of the $O_2$ sensor is computed from the successively sampled values. The computed value is compared with a predetermined value indicative of a slope value attained when the $O_2$ sensor is activated and thus it is considered that the $O_2$ sensor is activiated when the computed value is greater than the predetermined value.

7 Claims, 5 Drawing Figures

AIR-FUEL RATIO CONTROL APPARATUS

The present invention relates to an air-fuel ratio control apparatus for controlling the air-fuel ratio of an engine in accordance with the output of an $O_2$ sensor, and more particularly the invention relates to an air-fuel ratio control apparatus which is required to discriminate whether an $O_2$ sensor is activated after the starting of an engine.

Known air-fuel ratio control apparatus of the above type conventionally uses $O_2$ sensor activation discriminating means which comprises, for example, a method of discriminating that an $O_2$ sensor is activated when its output voltage exceeds a predetermined value as disclosed in Japanese Laid-Open patent application publication No. 52-97029. However, this method requires a comparison reference voltage source and two input signals, i.e., an $O_2$ sensor output voltage and a reference voltage must be compared to make an activation discrimination.

Also, a method may be conceived in which an air-fuel ratio feedback control loop is brought into operation as soon as an engine is started and an output voltage of an $O_2$ sensor which switches between high and low levels is detected in such a manner that the activation of the $O_2$ sensor is determined when the difference between the maximum and minimum values of the $O_2$ sensor output voltage exceeds a predetermined value. However, this method is disadvantageous in that the discrimination of activation of the $O_2$ sensor tends to be delayed.

The present invention overcomes the foregoing deficiencies in the prior art and it is an object of this invention to provide an air-fuel ratio control apparatus capable of discriminating the activation of an $O_2$ sensor in accordance with only the output voltage of the $O_2$ sensor.

To accomplish the above object, in accordance with the invention the output voltage of an $O_2$ sensor is sampled at intervals of a unit time so that the activation of the $O_2$ sensor is discriminated when the rate of change of the successively sampled values exceeds a predetermined value.

The present invention will be apparent from the following detailed description taken in conjunction with the accompanying drawings, in which.

The present invention will now be described in greater detail with reference to the illustrated embodiment.

Figure 1:
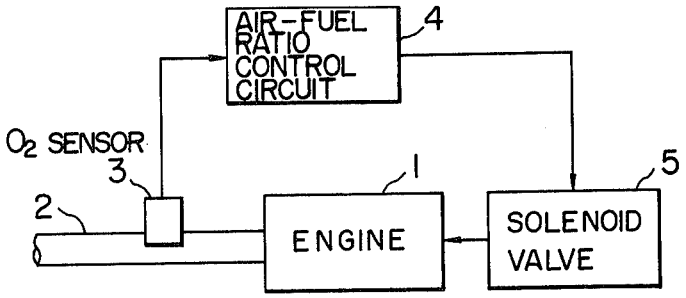
FIG. 1 is a schematic block diagram showing an example of an air-fuel ratio feedback control system to which the invention is applied.

FIG. 1 is a schematic block diagram showing an example of an air-fuel ratio feedback control system incorporating the invention. In the Figure, mounted in an exhaust pipe 2 of an engine 1 is an exhaust gas sensor or $O_2$ sensor 3 for detecting the concentration of oxygen in the exhaust gas from the engine 1. The detection output signal from the $O_2$ sensor 3 is applied to an air-fuel ratio control circuit 4 which in turn determines whether the air-fuel ratio of the mixture supplied to the engine 1 is rich or lean in accordance with the detection output signal. A control signal corresponding to the result of the determination is supplied to an air-fuel ratio adjusting solenoid valve 5 which in turn meters the amount of fuel supply or the amount of air supply to the engine 1 and thereby feedback controls the air-fuel ratio of the mixture.

Figure 2:
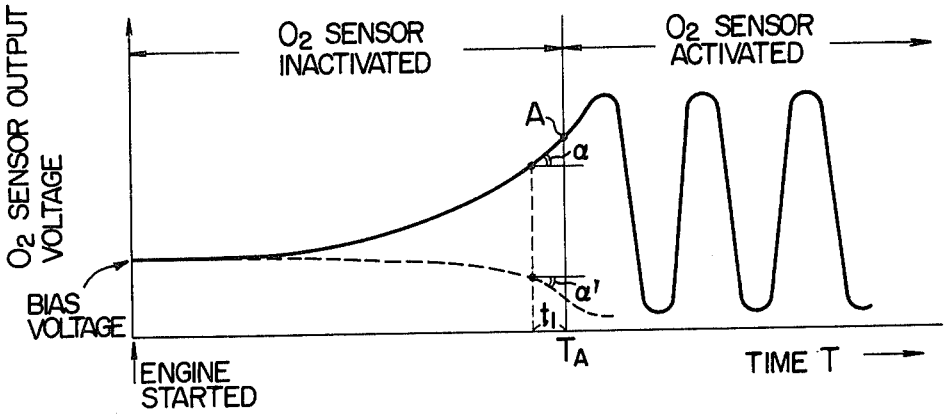
FIG. 2 is a graph showing an output voltage characteristic of an $O_2$ sensor.

FIG. 2 shows the relationship between the output voltage of the $O_2$ sensor 3 and the time after the engine starting when a bias voltage is applied to the $O_2$ sensor 3 upon the starting of the engine 1. Referring more particularly to the Figure, during the period immediately following the starting of the engine 1 the $O_2$ sensor 3 is still in an inactive state and also the air-fuel ratio feedback control is stopped. Thus, if, in this case, the air-fuel ratio of the mixture supplied to the engine 1 deviates on the rich side, the output voltage of the $O_2$ sensor 3 gradually rises from the bias voltage as shown by the solid line in FIG. 2. If the air-fuel ratio deviates on the lean side, the output voltage of the $O_2$ sensor 3 decreases as shown by the broken line in FIG. 2. Assuming that the $O_2$ sensor 3 is activated, for example, at a point A in FIG. 2 due to a rise in the temperature of the $O_2$ sensor 3 by the temperature of the exhaust gas, the air-fuel ratio feedback control can be initiated at this time $T_A$. As a result of the performance of the air-fuel ratio feedback control, the output voltage of the $O_2$ sensor 3 alternately changes between high and low levels after the time $T_A$.

Figure 3:
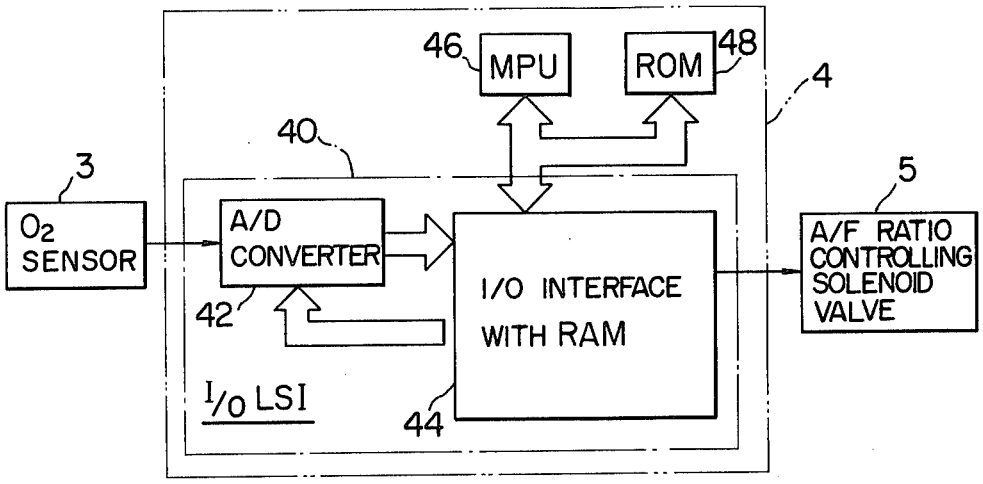
FIG. 3 is a block diagram showing the construction of an embodiment of an air-fuel ratio control apparatus according to the invention.

In accordance with the present invention, by simply checking the slope (the rate of change with time) of the output voltage curve of the $O_2$ sensor 3, it is possible to determine whether the $O_2$ sensor 3 is activated. FIG. 3 shows an embodiment of an air-fuel ratio control apparatus according to the present invention. In the Figure, the detection signal from the $O_2$ sensor 3 is applied to an A/D converter 42 formed within an input/output (I/O) LSI 40 in the air-fuel ratio control circuit 4 and thus the $O_2$ sensor output voltage detected as an analog value is converted to the corresponding digital value. The converted digital value is sent to an input/output interface 44 including an RAM or registers. The control of these operations as well as the computational and activation discriminating processings which will be described later are performed by an MPU (micro processing unit) 46 connected to the I/O LSI 40 through a data bus and a control signal bus in accordance with the program stored in an ROM (read only memory) 48 connected to the busses.

Figure 5:
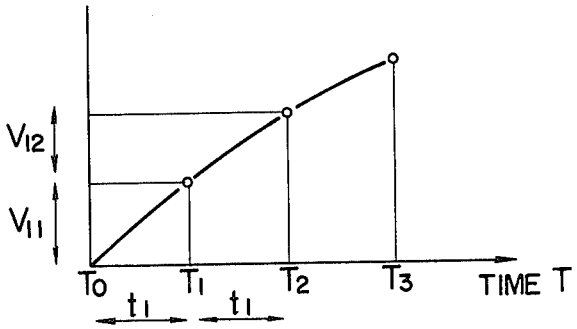
FIG. 5 is a graph showing the manner in which the output voltage of the $O_2$ sensor is sampled.

More specifically, in FIG. 3, when the starting of the engine 1 is detected, the MPU 46 inputs and stores the output signal of the $O_2$ sensor 3 as a digital value in the RAM (random access memory) or registers of the I/O LSI 40 through the A/D converter 42 at intervals of a predetermined time (0.48 sec in this embodiment). This process is shown in an enlarged form in FIG. 5. If the output voltage of the $O_2$ sensor 3 is sampled at intervals of a predetermined time $t_1$ (e.g., 0.48 sec), the output voltage changes by $V_{11}$ during the time $t_1$ from $T_0$ to $T_1$ and it changes by $V_{12}$ during the next time $t_1$ from $T_1$ to $T_2$. As a result, the slope of the output voltage curve of the $O_2$ sensor 3 at intervals of the time $t_1$ is expressed as $\Delta V_{ln}=V_{ln}/t_1$. The MPU 46 successively computes the slope $\Delta V_{ln}$ of the output voltage curve in accordance with the latest output voltage value inputted from the A/D converter 42 and the output voltage value previously inputted and stored in the RAM or registers. Where the sampling is effected at intervals of a predetermined time as in the present embodiment, the difference value between the two is proportional to the slope and the MPU 46 is required only to perform the operation of subtraction on two successive sampled values thus simplifying the computation. Then, the MPU 46 obtains the absolute value of the thus computed slope (the rate of change) of the output voltage curve of the $O_2$ sensor 3 and compares it with a preset value corresponding to a slope $\Delta V_{ls}$ of the output voltage curve obtained at the time of the activation of the $O_2$ sensor 3. In the case of this embodiment, the sampling period is fixed and therefore the value of $V_{ls}$ (e.g., 200 mV) is used as the preset value. This preset value can be determined by preliminarily examining the relationship between the activation state and the slope with respect to an $O_2$ sensor to be used. The MPU 46 compares the value $V_{ln}$ corresponding to the actual slope of the output voltage curve of the $O_2$ sensor 3 and the preset value $V_{ls}$. If, for example, the comparison at the point A in FIG. 2 results in $V_{ln} \geqq V_{ls}$, the MPU 46 determines that the $O_2$ sensor 3 is activated. When this decision is made, the MPU 46 issues a command to initiate the air-fuel ratio feedback control. When the feedback control is initiated, the output voltage curve of the $O_2$ sensor 3 alternately changes between the high and low levels through the operation of the solenoid valve 5 as is the case after the time $T_A$ in FIG. 2. Note that no decision is made as to the activation after the time $T_A$.

Figure 4:
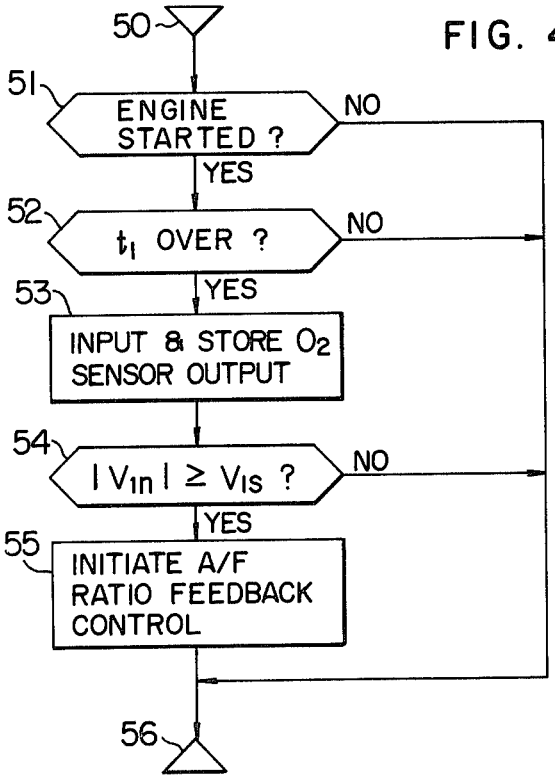
FIG. 4 is a flow chart useful for explaining the operation of the air-fuel ratio control apparatus according to the invention.

FIG. 4 shows these operations of the MPU 46 in the form of a flow chart. In the Figure, the processing is started by a step 50 and it is returned to the step 50 upon transferring to a step 56. A step 51 determines whether the engine 1 has started. If the engine 1 has started, a step 52 checks whether the sampling interval $t_1$ is over. When the sampling time is reached, a step 53 inputs and stores the output from the $O_2$ sensor 3 in the RAM or registers through the A/D converter 42. Then, a step 54 causes the MPU 46 to compute the value of $V_{ln}$ corresponding to the slope (the rate of change with time) of the output voltage curve and compare its absolute value $|V_{ln}|$ and the preset value $V_{ls}$. The reason for using the absolute value of $V_{ls}$ in this embodiment is that in accordance with this embodiment, after the engine 1 has started, when the air-fuel ratio of the mixture supplied to the engine 1 deviates on the rich side (the solid line in FIG. 2) and when the air-fuel ratio deviates on the lean side (the broken line in FIG. 2), respectively, the corresponding slopes ($\alpha$ and $\alpha'$ in FIG. 2) at the activation discrimination time (the point A in FIG. 2) of the $O_2$ sensor 3 are substantially the same in magnitude but are opposite in sign. In the case of this embodiment, there is no need to preliminarily adjust the air-fuel ratio of the mixture on the rich or lean side and also only the single preset value is required.

If it is preliminarily adjusted at the start of an engine so that the air-fuel ratio of the mixture is kept on the rich or lean side, there is no need to obtain the absolute value.

If the decision of the step 54 on $|V_{ln}| \geqq V_{ls}$ is YES, a transfer is made to the step 55 so that the MPU 46 initiates the operation of the air-fuel ratio feedback control loop and the activation discrimination processing is ended.

By so doing, by virtue of the fact that only the $O_2$ sensor output values sampled successively at intervals of a predetermined time are utilized so as to determine whether the $O_2$ sensor is inactivated or activated in accordance with the rate of change of the slope, it is possible to accurately make such a discrimination only if the desired $O_2$ sensor output values are detected.

I claim:

1. An air-fuel ratio control apparatus for controlling the air-fuel ratio of an engine in accordance with an exhaust gas sensor output comprising:

an exhaust gas sensor positioned in an exhaust system of said engine to sense the concentration of a selected exhaust gas component;

means for sampling an output voltage from said exhaust gas sensor;

means for computing the rate of change with time of the output voltage of said exhaust gas sensor in accordance with output voltage values sampled by said sampling means;

means for comparing said rate of change computed by said computing means and a preset value; and means responsive to the comparison result of said comparing means to control the initiation of an air-fuel ratio control.

2. An apparatus according to claim 1, wherein said sampling means initiates said sampling in response to a start of said engine.

3. An apparatus according to claim 1, wherein said preset value corresponds to the rate of change with time of the output voltage attained when said exhaust gas sensor is activated.

4. An apparatus according to claim 1, wherein said computing means computes the absolute value of the rate of change of the output voltage from said exhaust gas sensor, and wherein said comparing means generates an output signal commanding the initiation of an air-fuel ratio control when said absolute value is greater than said preset value.

5. An apparatus according to claim 1, further comprising means for storing an output voltage value sampled by said sampling means, and wherein said computing means further performs the operation of subtraction on a sampled output voltage value and a previously sampled output voltage value stored in said storing means.

6. An apparatus according to claim 5, wherein said sampling means performs said sampling at intervals of a predetermined time.

7. An apparatus according to claim 1, wherein said exhaust gas sensor is an $O_2$ sensor for sensing the concentration of oxygen in an exhaust gas.

* * * * *